United States Patent [19]

Porter

[11] 3,985,932

[45] Oct. 12, 1976

[54] PAPER COATING DISPERSIONS AND PROCESS

[75] Inventor: Rotheus Byram Porter, Darien, Conn.

[73] Assignee: Moore and Munger, Stamford, Conn.

[22] Filed: Aug. 5, 1974

[21] Appl. No.: 494,747

[52] U.S. Cl. ..... 428/326; 106/212; 106/271; 106/272; 162/135; 162/172; 162/184; 427/416; 428/486

[51] Int. Cl.[2] ..... B32B 29/00; D21H 1/28; D21H 1/36; B32B 5/16

[58] Field of Search ..... 106/85, 212, 271, 272, 106/10; 162/135, 172, 184, 222, 225; 427/152, 334, 416, 442, 14

[56] References Cited

UNITED STATES PATENTS

| | | | |
|---|---|---|---|
| 2,061,935 | 11/1936 | Delcroix | 162/172 |
| 2,343,065 | 2/1944 | Kumler et al. | 162/172 X |
| 2,406,336 | 8/1946 | Auer | 106/10 |
| 2,563,856 | 8/1951 | McGinn | 162/172 X |
| 2,563,857 | 8/1951 | McGinn | 162/172 X |
| 2,898,293 | 8/1959 | Capell et al. | 162/172 X |
| 2,993,800 | 7/1961 | Pickell | 106/271 |
| 3,085,040 | 4/1963 | Lovering et al. | 162/172 |
| 3,300,321 | 1/1967 | von Rosenberg et al. | 106/6 |
| 3,644,130 | 2/1972 | Cushman et al. | 106/268 |
| 3,791,839 | 2/1974 | Evans et al. | 106/271 X |

FOREIGN PATENTS OR APPLICATIONS

| | | | |
|---|---|---|---|
| 506,425 | 5/1939 | United Kingdom | 106/10 |

*Primary Examiner*—Joan E. Welcome

[57] ABSTRACT

By providing a dispersion system which incorporates hard waxes having high molecular weights and a melting point greater than 180°F., a unique paper coating additive is achieved. Preferably, the wax is powdered to a particle size less than 50 microns, and is dispersed in a system compatible with typical paper coating colors. In the preferred embodiments, high molecular weight Fischer-Tropsch waxes are employed.

15 Claims, No Drawings

PAPER COATING DISPERSIONS AND PROCESS

BACKGROUND OF THE INVENTION

This invention relates to paper coating additives and more particularly to a dispersion system for use as a lubricant additive.

Paper coatings are generally made from pigments, adhesives, and various additives employed for a variety of purposes. The pigment material usually comprises clay, while starch or protein is employed as the adhesive. Additives employed during the preparation of the paper coating, or at a later stage during the coating operation, include defoamers, lubricants, plasticizers, and other special property-producing chemicals.

This invention is generally concerned with paper coating additives employed as lubricants. Although a lubricant additive is primarily used to impart lubricity to the coatings, the additive also imparts plasticity to the color both in the wet an dry states, can modify the rheological properties, and can improve the gloss and ink receptivity of the finish coating. It has been generally stated that the ideal lubricant should lubricate the coating and improve its flow properties, should ensure a smoother coating, should improve the finish, should enhance th printing qualities, should reduce the tendency of the coating to crack or peel when the paper is folded, and should aid in the production process by decreasing or eliminating dusting and improve the paper finish without additional operations.

For many years, metallic soap dispersions, such as calcium stearate, have been used as a lubricant for pigmented paper coatings. Although many products have been tried as substitutes for calcium stearate, none have been totally successful. Although calcium stearate is an effective lubricant, a less expensive additive which imparts improved qualities to the paper coating has long been sought.

Therefore, it is a principal object of this invention to provide a paper coating additive for use as a lubricant having improved viscosity effects on the coating as compared to those normally found in prior art paper coating lubricants.

Another object of this invention is to provide a paper coating additive of the above character imparting a greater degree of gloss and brightness to paper coatings than those found in the prior art.

Another object of this invention is to provide a paper coating additive of the above character imparting better anti-dusting qualities to the final product than presently found in the prior art.

A further object of this invention is to provide a paper coating additive of the above character which is readily available, inexpensive, and compatible with typical paper coating colors.

Other and more specific objects will in part be obvious and will in part appear hereinafter.

SUMMARY OF THE INVENTION

In the paper coating additive of this invention, a hard, high molecular weight wax having a melting point greater than 180° F. is employed. Preferably, the wax is powdered to a particle size less than 50 microns and mixed with a surfactant and water to form a dispersion system for use as an additive to the paper coating color. The paper coating color generally comprises a pigment component, usually consisting of clay, an adhesive component, usually consisting of starch, and various additives employed to impart desired characteristics to the final paper product.

In the preferred embodiments, a Fischer-Tropsch wax is employed in the dispersion systems of this invention. It has been found that the characteristics of the Fischer-Tropsch wax best meet all of the requirements for the wax additive in the dispersion systems of this invention. However, other hard, high molecular weight waxes or polymers, such as stearamides, polyethylenes, and high melt microcrystalline waxes can be employed with substantially equal success.

Generally, it has been found that the use of a powdered wax having a particle size less than 50 microns, a molecular weight greater than 700 and a melting point greater than 180° F. provides a paper coating additive which imparts improved qualities to a paper coating than has been found with prior art lubricant additives.

In the preferred embodiments the hard, high molecular weight wax is employed in a dispersion system which incorporates water and a surfactant. This dispersion system is used as any typical lubricant additive would be used in the formulation of a paper coating color.

The wax dispersion of this invention is prepared by first adding a surfactant to the water which is allowed to disperse. Then the powdered wax is slowly added and mixed until thoroughly wetted. Various types of mixers can be used to achieve the proper consistency, but air entrapment should be kept to a minimum. After the initial dispersion has been formed, the dispersion system is passed through a colloid mill in order to disperse any remaining particle agglomerates. After deaeration of the finished dispersion, the dispersion system of this invention is ready for use in the proper coating color.

The invention accordingly comprises the several steps and the relation of one or more such steps with respect to each of the others, and the composition possessing the features, properties and relation of components, which are exemplified in the following detailed disclosure and the scope of the invention will be indicated in the claims.

DETAILED DESCRIPTION

The dispersion systems of this invention comprise wax between about 20% and 65% by weight, surfactants between 0% and 10% by weight, and water forming the balance. Although substantially all hard, high molecular weight waxes can be employed in the dispersion systems of this invention, high molecular weight Fischer-Tropsch waxes are preferred. However, usable substitutes for the Fischer-Tropsch wax are polyethylenes, hard, high melt point micro-crystalline waxes, ester waxes, stearamides and other waxes having a molecular weight greater than 700.

The surfactants employed in the dispersion system of this invention can be either anionic or non-ionic. Only cationic surfactants have been found to be undesirable due to their limited compatibility with the pigmented paper coating colors. Preferably, non-ionic surfactants are employed because of their inherent stability over a wide pH range.

Although many different types of non-ionic surfactants can be successfully employed in the dispersion system of this invention, it has been found that non-ionic surfactants containing ethylene oxide and having a hydrophile-lipophile balance (HLB) number between about 12 and 14 perform the best. Examples of these preferred surfactants are Igepal CO-630 manufactured by the GAF Corporation, Triton N-100 manufactured by the Rohm and Haas Company, and the Teric "N" series manufactured by I.C.I.A.N.A., Limited. All of these surfactants are known in the art and are commercially available.

Typical surfactants that can be successfully employed in the dispersion systems of this invention are polyethylene glycol ethers of linear alcohols, polyethylene glycol esters, and polyoxyethylene esters of fatty acids. Specifically, nonyl or octyl phenoxy polyethoxy ethanol and bis(tridecyl) ester of sulfsuccinic acid are some surfactants which have been successfully employed. These surfactants are merely representative of the various types of surfactants that can be used in the dispersion system of this invention and, as would be obvious to one skilled in the art, other similar surfactants can be employed.

In order to prepare the dispersion system additive of this invention, the surfactant is first added to water at room temperature and is allowed to disperse with gentle agitation. The powdered wax is then slowly added and mixed until thoroughly wetted. Various types of well-known mixers can be employed, but care should be exercised in order to keep air entrapment to a minimum. After the initial dispersion system has been formed, the dispersion system is passed through a colloid mill, or other similar device, in order to disperse any remaining agglomerates. In order to assure the elimination of entrapped air, deaeration of the dispersion system is generally necessary. Deaeration can be accomplished by using defoaming agents, well-known in the art, or by employing vacuum deaerating equipment, also well-known in the art.

After deaeration, the dispersion system of this invention is ready for use as a lubricant additive to the paper coating. The dispersion system can be added to the paper coating at any convenient point, depending upon the particular coating process being employed.

Although the wax dispersion system defined above is preferred and has been found to work the best as an entire dispersion system additive to the coating, it is possible to employ the powdered, high molecular weight wax having a melting point greater than 180° F in combination with only the surfactant as the additive to the coating. This combination would provide a dispersible wax paper coating additive which could be employed as required in the formulation of the coating color. The dispersible wax additive should comprise between about 80% and 99% wax and between about 1% and 20% surfactant.

It has been found, however, that although the dispersible wax additive could be employed, difficulty in achieving the desired thorough dispersion of the additive throughout the paper coating mixture has been noted. Therefore, a preferred embodiment of the paper coating additive of this invention comprises the dispersion system with the water incorporated therein.

The amount of additive incorporated in a paper coating is dependent upon the particular effects desired for the application and properties of the coating. By increasing the percentage of wax, such effects as gloss are improved, however, other properties such as slip and ink absorption are adversely affected. Also, it has been found that the powdered wax should have a particle size less than 50 microns. Particle size greater than 50 microns can cause imperfections in the coating film, such as scratch marks and poor gloss.

A typical all purpose dispersion system comprises about 45% wax, 2% surfactant, and 53% water. After the dispersion system has been formulated in the process defined above, the dispersion system would exhibit the properties shown in Table I.

TABLE I

| Properties of Dispersion | |
|---|---|
| Solids Content % | 40–50 |
| Color | White |
| Particle Size (microns)(range) | 1–10 |
| Consistency | Fluid |
| pH | 7–9 |

It has been found that the dispersion system having the percentages defined above and the properties shown in Table I provides a typical all purpose paper coating additive imparting improved characteristics to the final paper product better than those presently attainable with the use of metallic soap dispersions such as calcium stearate.

The preparation of paper coating colors varies, and depends upon the particular preference of the mill producing the paper product. General procedures for coating mixture preparations can be found in Tappi Monograph Pigmented Coating Processes", Page 105–211, published by Technical Association of The Pulp And Paper Industry, 1964.

In general, the adhesive and pigment dispersions are prepared separately. However, in some methods the two are prepared together. The starch, which is generally a low viscosity type or enzyme converted, is cooked in water at a concentration of 20% to 25% solids by heating to 200°–210° F. and held at this temperature for 15 to 20 minutes. The solution is then cooled and added to the pigment dispersion.

The pigment dispersion is prepared in a variety of ways, but a simple procedure is to add the dispersing agent to water followed by the pigment in amounts which will give a dispersion of about 60% to 70% solids.

After blending of the adhesive and pigment dispersions, the amount of solids are adjusted to the desired level, and then the various additives are added as required. A typical coating composition for publication grade paper is shown in Table II and a typical coating composition for offset printing is shown in Table III.

TABLE II

| Publication Grade Paper | |
|---|---|
| Compound | Parts |
| Clay | 100 |
| TSPP | 0.2 |
| Starch, converted | 14.0 |
| Alkali to raise pH | 9–10 |
| Calcium stearate 50% Solids | 1–2 |
| Water to make 60% solids | |

TABLE III

| Offset Printing Paper | |
|---|---|
| Compound | Parts |
| $TiO_2$ | 5 |
| $CaCO_3$ | 10 |
| Clay | 85 |
| Starch, converted | 12 |
| TSPP | 0.2 |
| Latex | 6.0 |
| Alkali to raise pH | 9–10 |
| Calcium Stearate 50% Solids | 1–2 |
| Water to make 65% solids. | |

Tables II and III are merely representative compositions for the two types of paper coatings employing calcium stearate as the lubricant. Many other formulas, which are well-known in the art, can be found in the following references along with discussions of various additives and various substitutes for the compounds employed:

Tappi Monograph No. 1 "Preparation of Paper Coating Colors"

Tappi Monograph No. 17 "Starch and Starch Products in Paper Coatings"

Tappi Monograph No. 22 "Synthetic and Protein Adhesives for Paper Coating"

Tappi Monograph No. 25 "Paper Coating Additives"

Tappi Monograph No. 28 "Pigmented Coating Processes"

Interscience Publishers, Inc. 1961 "Pulp and Paper", J. P. Casey, Vol. III

American Cyanamid Co. "Alwax and Waxine Sizes"

Hercules, Inc. "Paracol Wax Emulsions"

Nopco Chemical Co., Div. of Diamond Shamrock Corp. "Nopco Wax Sizes for the Paper Industry"

Nopco Chemical Co., Technical Bulletin "Calcium Stearate Dispersion"

In most paper coatings, the lubricant additive comprises a minimum of 0.1% to a maximum of 5% by dry weight based on the weight of coating solids. In most applications, however, a lubricant additive is commonly maintained between 0.5% to 2% by dry weight of the additive based on the weight of coating solids.

As with the prior art use of lubricant additives, the dispersion system of this invention would be employed with the solid components of the dispersion system being maintained between the same percentage ranges presently employed in the art. Generally, as in most paper coatings, the lubricant component of the coatings of this invention comprises between about 1% and about 2% by dry weight of the solid components of the dispersion system additive of this invention based upon the weight of coating solids.

As discussed above, the wax dispersion system of this invention, besides being more economical to employ than the calcium stearate dispersion presently employed in the art, provides a superior lubricant additive for paper coatings than is presently obtainable with calcium stearate. In order to show the superiority of the wax dispersion system of this invention over calcium stearate dispersions, comparative tests were performed using the identical percentage amounts for the calcium stearate dispersions and the wax dispersions of this invention in the same master coating formulation. The test results and the master coating formulations are shown in Tables IV and V.

TABLE IV

Test Results of Wax Dispersion Additive of This Invention Compared With Calcium Stearate Dispersion

| Material Used | Per Cent On Total Binder Level (18 pts) | Hercules Hi-Shear Visc.[1] Fresh T-1000 (CM) | Hercules Hi-Shear Visc.[1] 6 Hrs Age T-1000 (CM) | Brookfield[2] Viscosity 80° F. (CPS) | pH | Solids |
|---|---|---|---|---|---|---|
| — | — | 7.8 | 7.5 | 1670 | 7.5 | 54.6 |
| Calcium Stearate Dispersion | 5 | 8.1 | 8.1 | 2790 | 7.6 | 54.6 |
| Calcium Stearate Dispersion | 10 | 8.4 | 7.6 | 2910 | 7.6 | 54.5 |
| Calcium Stearate Dispersion | 20 | 7.9 | 7.8 | 2750 | 7.7 | 54.5 |
| Wax Dispersion | 5 | 6.4 | 6.3 | 1650 | 7.5 | 54.5 |
| Wax Dispersion | 10 | 6.5 | 6.7 | 2000 | 7.6 | 54.5 |
| Wax Dispersion | 20 | 6.8 | 6.7 | 2140 | 7.6 | 54.5 |

Master Coating Formulation

| | | |
|---|---|---|
| Coating Clay | 100.0 | parts |
| Sodium Salt of Polymeric Carboxylic Acid | 0.25 | " |
| Tetrasodium Pyrophosphate | 0.1 | " |
| Converted Starch - Dry | 12.0 | " |
| Polyvinyl Acetate - Dry | 6.0 | " |
| Preservative | 0.6 | " |

Total Solids 54.6%

Coating Weight In All Cases - 8.5 lb/3000 ft²

[1]80°F. "A" bob 5 × 10⁴ springs

[2]No. 4 spindle 60 RPM

TABLE V

Test Results of Wax Dispersion Additive of This Invention Compared With Calcium Stearate Dispersion

| Material Used | Gardner Gloss | Photovolt Brightness | Photovolt Opacity | Dust Test Rating | IGT Pick[3] No. 6 Ink(FPM) | IPI Orange Ink[4] Holdout Test Gloss | IPI Orange Ink[4] Holdout Test % Change |
|---|---|---|---|---|---|---|---|
| Tappi Standard | T-480-ts65 | T-452-m-58 | T-425-m-61 | — | T-499-SU-64 | — | — |
| — | 66.5 | 82.0 | 94.5 | 7.0 | 365 | 68.0 | 2.2% Increase |
| Calcium Stearate Dispersion | 69.0 | 82.5 | 94.0 | 6.0 | 385 | 71.0 | 2.8% Increase |
| Calcium Stearate Dispersion | 67.0 | 83.0 | 95.5 | 5.0 | 400 | 69.0 | 2.9% Increase |
| Calcium Stearate Dispersion | 68.0 | 83.0 | 94.5 | 4.0 | 365 | 64.0 | 5.8% Increase |
| Wax Dispersion | 69.0 | 83.0 | 95.0 | 3.0 | 355 | 71.0 | 2.8% Increase |
| Wax Dispersion | 70.0 | 83.5 | 94.5 | 2.0 | 365 | 72.0 | 2.8% Increase |
| Wax Dispersion | 70.0 | 83.0 | 94.5 | 2.0 | 355 | 71.0 | 1.4% Increase |

Master Coating Formulation

| | | |
|---|---|---|
| Coating Clay | 100.0 | parts |
| Sodium Salt of Polymeric Carboxylic Acid | 0.25 | " |
| Tetrasodium Pyrophosphate | 0.1 | " |
| Converted Starch - Dry | 12.0 | " |
| Polyvinyl Acetate - Dry | 6.0 | " |
| Preservative | 0.6 | " |

Total Solids 54.6% lbs.

TABLE V-continued

Test Results of Wax Dispersion Additive of This Invention Compared With Calcium Stearate Dispersion
Coating Weight In All Cases - 8.5lb/3000 ft²

[3]B spring 50 Kg Printing Pressure
[4]A spring 35 Kg Printing Pressure

As shown in Table IV, the wax dispersion system of this invention imparts a lower viscosity to the paper coating color than the calcium stearate dispersion. This is an important advantage over calcium stearate, since the viscosity of the paper coating color is a critically important property for the application of the coating to the paper.

In Table V, it can be readily seen that the gloss and brightness obtained with the wax dispersion system of this invention is slightly better than that produced with the calcium stearate dispersion. Furthermore, the anti-dusting properties obtained with the wax dispersion system of this invention is considerably better than the properties obtained with calcium stearate dispersions. Since the lower the dust rating the better anti-dusting properties the product has, it can readily be seen in Table V that the wax dispersion system of this invention provides about a 50% reduction in the dust test rating over the calcium stearate dispersion.

The only test in which the wax dispersion system of this invention was slightly less effective than the calcium stearate dispersion is found in the ink test. As shown in Table V, the wax dispersion system of this invention is slightly less effective toward resistance to ink pick than the calcium stearate dispersion.

It can readily be seen, from the above discussion, that the wax dispersion system of this invention provides an improved product over the calcium stearate dispersion systems presently employed in the art.

It will thus be seen that the object set forth above among those made apparent from the preceding description, are efficiently attained, and, since certain changes may be made in carrying out the above process and in the composition set forth without departing from the scope of the invention, it is intended that all matter contained in the above description shall be interpreted as illustrative and not in a limiting sense.

It is also to be understood that the following claims are intended to cover all of the generic specific features of the invention herein described, and all statements of the scope of the invention which, as a matter of language, might be said to fall therebetween.

Particularly, it is to be understood that in said claims, ingredients or compounds recited in the singular are intended to include compatible mixtures of such ingredients wherever the sense permits.

Having described my invention, what I claim is new and desire to secure by Letters Patent is:

1. In a publication paper coating for use in the manufacture of publication paper to enhance the ink receptivity of the paper, a dispersion composition comprising:

A. between about 70 and 95 percent by weight of clay;

B. between about 5 and 20 percent by weight of a binder selected from the group consisting of starch and latex;

C. between about 0.1 and 2 percent by weight of a dispersing agent;

D. between about 0.1 and 5 percent by weight of a lubricant consisting essentially of a. between about 80% and 99% by weight of a hard, high molecular weight wax having a melting point greater than 180° F.; and b. between about one and 20% by weight of a surfactant, wherein said composition is dispersed in a sufficient quantity of water to obtain a solid content between 50 and 75 percent.

2. In a publication paper coating dispersion system which enhances the ink receptivity and spreadability and incorporates clay, a binder, a dispersing agent, and a lubricant, the improvement comprising a lubricant consisting essentially of A. between about 20% and 65% by weight of a hard, high molecular weight wax having a melting point greater than 180° F.;

B. between about 35% and 80% by weight water; and

C. up to 10% by weight of a surfactant.

3. A publication paper dispersion system as defined in claim 2, wherein said hard, high molecular weight wax is powdered to a particle size less than 50 microns.

4. A publication paper dispersion system as defined in claim 2, wherein said hard, high molecular weight wax comprises a Fischer-Tropsch wax.

5. A publication paper dispersion system as defined in claim 2, wherein said wax is one selected from the group consisting of polyethylene, micro crystalline waxes, ester waxes, and stearamides.

6. A publication paper dispersion system as defined in claim 2, wherein said wax has a molecular weight greater than 700.

7. A publication paper dispersion system as defined in claim 2, wherein said surfactant is an anionic surfactant.

8. A publication paper dispersion system as defined in claim 2, wherein said surfactant is a nonionic surfactant.

9. A publication paper dispersion system as defined in claim 8, wherein said surfactant has a hydrophile-lipophile balance number between about 12 and 14.

10. A publication paper dispersion system as defined in claim 2, wherein said surfactant is one selected from the group consisting of nonyl phenoxy poly ethoxy ethanol, octyl phenoxy poly ethoxy ethanol, and bis(-tridecyl) esters of sulfosuccinic acid.

11. A publication paper dispersion system as coating dispersion system which enhances the ink receptivity and spreadability and incorporates clay, a binder, a dispersing agent, and a lubricant, the improvement comprising a lubricant comprising:

A. between about 80% and 99% by weight of a hard, high molecular weight wax having a melting point greater than 180° F.; and B. between about 1% and 20% by weight of a surfactant.

12. A publication paper dispersion system as defined in claim 11, wherein said hard, high molecular weight wax is powdered to a particle size less than 50 microns.

13. A publication paper dispersion system as defined in claim 11, wherein said hard, high molecular weight wax comprises a Fischer-Tropsch wax.

14. A publication paper dispersion system as A lubricant defined in claim 11, wherein said hard, high molecular weight wax has a molecular weight greater than 700.

15. A process for preparing publication paper having desirable ink receptive qualities for a variety of inks comprising for the steps of A. mixing a dispersion agent in water;

B. mixing clay into the water and dispersion agent solution;

C. separately preparing an adhesive;

D. mixing the adhesive into the clay dispersion solution;

E. separately preparing a lubricant additive by a. dispersing a surfactant in water at room temperature with gentle agitation;

b. slowly adding and mixing a hard, high molecular weight wax in the surfactant and water mixture until said wax is thoroughly wetted;

c. dispersing any remaining particle agglomerates; and d. de-aerating the lubricant dispersion system, F. mixing the lubricant additive in the clay-adhesive dispersion;

G. adjusting the water quantity to obtain the desired solid content; and

H. coating manufactured raw paper with the dispersion system, thereby imparting the desired characteristics to the resulting publication paper.

* * * * *

UNITED STATES PATENT OFFICE

CERTIFICATE OF CORRECTION

Patent No. 3,985,932 Dated October 12, 1976

Inventor(s) Rotheus Byram Porter

It is certified that error appears in the above-identified patent and that said Letters Patent are hereby corrected as shown below:

Title of Invention: PAPER COATING ADDITIVES

Column 1, line 20, "an" should be --and--
Column 1, line 26, "th" should be --the--
Column 2, line 34, "proper" should be --paper--
Column 4, line 26, after "monograph", insert --No. 28,"--
Column 5, line 26, after "dry", insert --weight based on the weight of coating solids. In most--
Column 6, Table IV - in Headings, insert --%-- over "Solid"

After Table IV, delete "weight based on the weight of coating solids. In most"

Table V, under % Change Column, line 5, after "5.8%", "Increase" should be --Decrease--
Column 8, line 56, is changed as follows: Insert the word "In" at the beginning of the sentence and change "A" to "a". Also, delete the words "as coating dispersion system".
Column 9, line 4, after "as", delete the words "A lubricant".

Signed and Sealed this

Eighth Day of March 1977

[SEAL]

*Attest:*

RUTH C. MASON
*Attesting Officer*

C. MARSHALL DANN
*Commissioner of Patents and Trademarks*